US007681266B2

(12) United States Patent
Gerlach

(10) Patent No.: US 7,681,266 B2
(45) Date of Patent: Mar. 23, 2010

(54) ADJUSTABLE RECLINER BED

(76) Inventor: Randy Jean Gerlach, 50 Ardendale Dr., Daly City, CA (US) 94014

( * ) Notice: Subject to any disclaimer, the term of this patent is extended or adjusted under 35 U.S.C. 154(b) by 105 days.

(21) Appl. No.: 11/649,378

(22) Filed: Jan. 3, 2007

(65) Prior Publication Data

US 2007/0157393 A1 Jul. 12, 2007

Related U.S. Application Data

(60) Provisional application No. 60/757,208, filed on Jan. 6, 2006.

(51) Int. Cl.
*A47G 7/00* (2006.01)

(52) U.S. Cl. ..... 5/655; 5/632; 5/640

(58) Field of Classification Search ..... 5/655, 5/630, 632, 640
See application file for complete search history.

(56) References Cited

U.S. PATENT DOCUMENTS 2,281,629 A * 5/1942 Snow ..... 5/655
5,387,177 A * 2/1995 Dunn ..... 600/22
5,439,008 A * 8/1995 Bowman ..... 128/875
5,448,790 A * 9/1995 Saro et al. ..... 5/657

* cited by examiner

*Primary Examiner*—Fredrick Conley
(74) *Attorney, Agent, or Firm*—Ariel S. Bentolila; Bay Area IP Group, LLC

(57) ABSTRACT

An adjustable reclining infant bed apparatus having a head base with at least one elevating wedge attachable on a center side surface of the foot base is shown. The elevating wedge operates to elevate the head base at an angle. A foot base is shown comprising a lower body support surface having a modified S curve shape. Head and foot base are connected at center sides with hook and loop fastener. Connecting flaps attachable to the head base and the foot base reinforce connection of the head base to the foot base. The connecting flaps are configured to provide ports to the head base and the foot base. A triangular harness having one attachable point for attaching to the foot base and two attachable points for attaching to the head base and three attachable points to separate mattress pad is shown. The triangular harness is configured to support a torso of an infant.

21 Claims, 5 Drawing Sheets

ADJUSTABLE RECLINER BED

CROSS-REFERENCE TO RELATED APPLICATIONS

The present Utility patent application claims priority benefit of the U.S. provisional application for patent U.S. 60/757,208, entitled "Adjustable recliner bed" and filed on Jan. 06, 2006 under 35 U.S.C. 119(c). The contents of this related provisional application are incorporated herein by reference.

FIELD OF THE INVENTION

The present invention relates generally to beds. More particularly the invention relates to an adjustable reclining bed for infants.

BACKGROUND OF THE INVENTION

In some cases, infants may develop problems such as, but not limited to, gastric reflux, asthma, pneumonia or other infections, or surgical conditions that treatment can be supplemented by the proper positioning of the infant's head, neck and chest. Raising the infant's head and chest in proper alignment, can open the airway assisting air exchange, and allow gravity to help keep food in the stomach while allowing gas to escape through a patent esophagus by burping. Known devices for positioning infants for gastric reflux or trachea malacia are variations of supportive pillows of soft or in some cases beaded filling or memory foam wedges, that do not provide the flat firm surface recommended by the American Academy of Pediatrics for prevention of sudden infant death syndrome (SIDS), or side borders to prevent infant from rolling off of the bed. In addition, these devices can conform to an infants face, thereby increasing risk of suffocation, or allow for sliding down and possible slumping of the head and neck, occluding the airway and presenting an asphyxiation risk or poor air exchange to the lungs.

Some known devices are larger foam wedges providing only one angle of elevation with harnesses or are just harnesses or slings for supporting the buttocks and groin area, strapping the infant in place, where he hangs on a foam wedge, plastic board or inclined mattress, with the harness being the main supporting element of the lower body. The harnesses can be difficult to apply and remove, restricting access to infant and impeding care. Support with only a harness can also be restrictive to the infant, uncomfortable, and even cutting off the blood circulation to the legs.

Yet other known devices for infant positioning are recommended for use in the prone position, which is no longer recommended by the American Academy of Pediatrics for the prevention of SIDS; however, the prone position is acceptable positioning of premature infants on cardio-pulmonary monitors. The aforementioned are not commonly used in hospitals or advertised for public use. What is commonly used in hospitals and in the home to position infants are pillows and rolled up blankets to prop up the infant on flat or elevated mattresses or in non-adjustable infant seats or car seats.

In view of the foregoing, a device is needed for the adjustable positioning of an infant's head, neck and chest that will alleviate gastric reflux or airway blockage and is safe for the infant, easy to use and effective. It would further be desirable if device also provides safe, easy, effective, accessible and comfortable positioning of an infant's head, neck, chest and lower body, to facilitate effective air exchange and for the relief of gastric reflux (at least a 30 degree inclination is recommended, to employ gravity to keep food in stomach and facilitate gas to be expelled by burping), apnea associated with airway blockage due to poor positioning of the head, and dyspnea related to cardiac and or pulmonary conditions such as asthma, bronchiolitis, pneumonia, other infections, prematurity, surgical conditions or lack of muscle tone, in the hospital or home setting.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
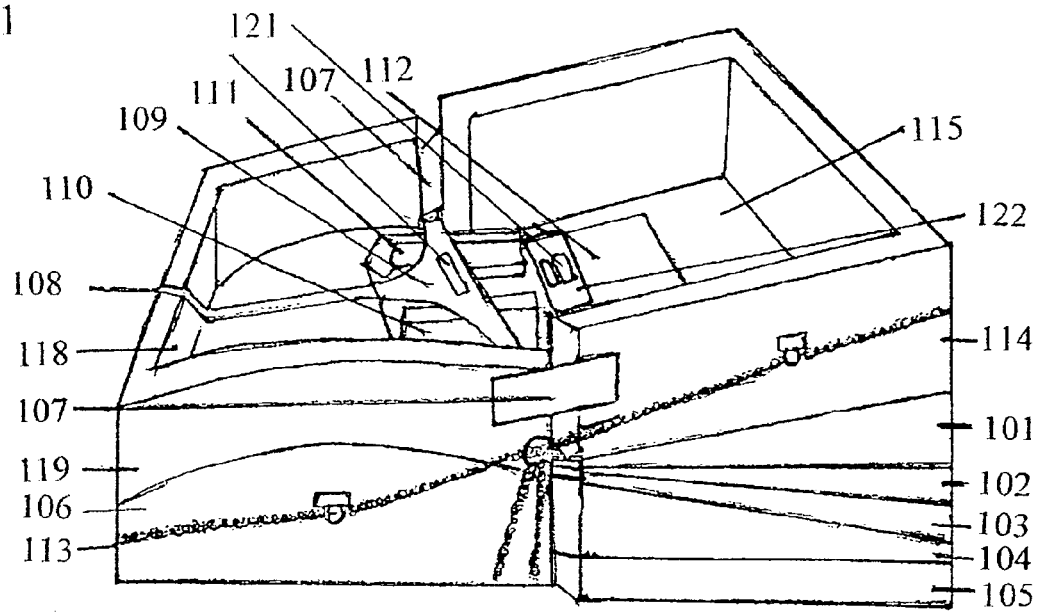
FIG. 1 illustrates an overall side view of an exemplary adjustable reclining bed with all of its elements in working position, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus for an adjustable recliner bed is described.

In one embodiment, an adjustable reclining infant bed apparatus having a head base with at least one elevating wedge attachable on center, side surface of the foot base. The elevating wedge operable to elevate the head base at an angle. A foot base is shown comprising a lower body support surface having a modified S curve shape. Head base is connected to foot base with hook and loop fasteners at center side surfaces. A plurality of connecting flaps attachable to the head base boarders and the foot base boarders reinforce connection of the head base to the foot base. The connecting flaps are configured to provide ports between the head base and the foot base. A triangular harness comprising a hook and loop strip for securing medical equipment, three attachable points for attaching to mattress pad, one attachable point for attaching to the foot base and two attachable points for attaching to the head base is shown. The triangular harness is configured to support a torso of an infant.

Additional embodiments include additional elevating wedges, raised borders on the bed, and a safety cord attachable to a side of the foot base and an adjoining side of the head base for securing the apparatus to an external structure. Further embodiments also include a mattress configured to fit on a top surface of the joined head base and foot base, and a plurality of positioning wedges configured to support sides of the infant. The positioning wedges being attachable to the mattress pad and mattress pad being attachable to sheet covering mattress. Additional embodiments also include a wide band belt configured to provide chest support for the infant and securing of medical equipment, the wide band belt being attachable to the head base, or around the infant's chest and a separate vest harness configured to provide support for medical equipment for use with the larger infant or toddler. Further embodiments include the ports having a configuration for securing cables and tubes passing into the bed. In other embodiments, the bed is constructed from a foam type material. In another embodiment the mattress comprises an insert of memory type foam in a buttocks support area.

In another embodiment, an adjustable reclining infant bed apparatus having a bed means for an infant to sleep in, and an elevating means for adjusting an inclination of the bed means is shown. Further embodiments include a torso support means for supporting a torso of the infant, a positioning means for facilitating proper body alignment of the infant in the bed means, a securing means for securing cables and tubes passed into the bed means, a means for providing chest support for the infant, and a means for securing the bed means to an external structure.

Other features, advantages, and objects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

An adjustable recliner bed will be described in which the preferred embodiment combines a baby bed and an adjustable recliner. It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details. It is to be further understood that while many design features are described below in the context of complying with pertinent government regulations, alternative embodiments and applications of the present may include corresponding design features that may be only partially or not at all in compliance, such non-compliant embodiments and applications of the present invention are none-the-less within the scope of the present invention. Likewise, all safety oriented design features are optional, and may be replaced with any suitable implementation approach known to those skilled in the art.

FIG. 1 illustrates an overall side view of an exemplary adjustable reclining bed with all of its elements in working position, in accordance with a preferred embodiment of the present invention. In the present embodiment, a head base 101 is supported, and elevated by an angled 2 inch foam wedge 102, a second angled 2 inch foam wedge 103, an angled 4 inch foam wedge 104 and a 1½ inch thick flat base 105, which are attached to a foot base 106 with hook and loop fasteners at the center conjunction point. Elevating wedge 102, wedge 103, wedge 104 and flat base 105 are removable and can be positioned in different configurations to obtain different degrees of elevation ranging from approximately 20 to 50 degrees. In the present embodiment, head base 101 is 4 inches wider than foot base 106, creating overlapping side borders 114 and 119 at the center conjunction which are connected with hook and loop fasteners on vinyl flaps 107 that afford and secure ports for monitor cables, intravenous and oxygen tubing, or a vibrating wand. In the present embodiment, bottom side border 118 has a 5½ inch long, ½ inch wide slit 108 forming another port for securing afore mentioned cables or tubes. The three ports provided help prevent entanglement of the monitor cables and tubes and possible constriction of the limbs or neck of the infant. The side conjunction ports also allow for a cordless massager to be placed under mattress providing gentle, soothing vibration employed to comfort the compromised or healthy infant. Foot base 106 is a modified S curve design that comfortably supports the lower body without restricting circulation to the legs, and, for added support, foot base 106 also has a triangular harness 109 with a hook and loop strip for fastening medical equipment 121 attached with hook and loop fasteners to mattress pad 112 and foot 106 and head 101 bases. There is a soft cloth wide band belt 122 for additional chest support and/or securing of medical equipment with a hook and loop fastener 121, that can be attached with hook and loop fasteners to the head base, or around the infant's chest.

It is contemplated that other embodiments of the present invention may implement other suitable shapes than the S curve design, depending upon the needs of the particular application, for example, without limitation, the foot base could be flat, however this embodiment does not give the lower body support accomplished with the modified S curve but may be more suitable in a different application for older children up to adult. The foot base could also be mechanized with some metal support structure, to raise or lower as desired, manually like a lawn chair, or electrically like a hospital bed providing more varied elevation and positioning of lower body. Further positioning support of the infant is achieved by two 8 inch long foam positioning wedges 110 and 111 attached along with harness 109 to a vinyl, waterproof mattress pad 112 with hook and loop fasteners. In the present embodiment, there is a separate 1½ inch thick mattress 115, cut to form, providing a firm flat sleeping and positioning surface, recommended by the American Academy of Pediatrics for the prevention of SIDS. There is also a safety cord 113 attached to the head boarder 114 and foot base 106 for anchoring the bed to a crib and to prevent tipping by more vigorous infants.

In the present embodiment, the non-rigid frame is of foam construction; however, in alternate embodiments of the present invention another non-rigid support structure such as, without limitation, rubber may be used or some kind of space age balloon material that is waterproof, non flammable and puncture resistant.

In the present embodiment, the weight of the bed is approximately 21 lb with accessories. The length is 35 inches total with head base 101 being 16 inches long and foot base 106 being 19 inches long. The width is 23¼ inches at head base 101 and 19½ inches at foot base 106. The height is 23½ inches at the highest elevation of head base 101 and 16 at the lowest elevation, and 15 inches at foot base 106. Measurements are from the tops of side borders 114 and 119. The entire unit fits in regular or porta-type cribs and can be covered with a fitted twin sheet secured under the unit to prevent infant from pulling up sheet and becoming entangled and possible suffocated. The mattress can be covered with a king size pillowcase. A covering for the foam is recommended to help prevent choking incidents resulting from accidental punctures or tears to the foam, allowing for small pieces of foam to come loose and create a choking hazard for the baby and will be included with present embodiment as an accessory (not shown). The bed may also be placed on floor. In the present embodiment, side boarders 114, 118 and 119 are 8 inches high, 2 inches thick, and overlap at the conjunction site of head base 101 and foot base 106, as head base 101 is 4 inches wider than foot base 106. The measurements provided are for the preferred embodiment of the present invention, and those skilled in the art, in light of the present teachings, will recognize that alternate measurements may also be suitable for an adjustable reclining infant bed and its accessories.

The present embodiment is fire retardant foam construction and preferably meets government regulations, such as, without limitation, Technical Bulletin 117 California Bureau of Home Furnishings. The present foam embodiment is covered with a flame retardant fabric, an Alessandra FR Jersey Knit Sleeve and an outer covering of 2 mil Pul, 100% polyester knit laminated with 2 mil waterproof, non-breathable backing that is mildew proof and highly abrasion resistant, or covered with nonflammable, waterproof material not limited in but including paint, meeting pertinent government regulations; such as, without limitation, the requirements of CA TB 603. The hook and loop fasteners are preferably flame retardant, and meet pertinent government regulations; such as, without limitation, the NFPA 701 Flame Resistance and MIL-F-21840F shear strength requirements. The vinyl accessories are preferably waterproof, tear resistant, rot resistant, and are in compliance with pertinent government regulations; such as, without limitation. NFPA 701 Flame Resistance and State of California F-222.03 Flame Retardant Rating. The harness is preferably made of waterproof, flame retardant material, and latex free elastic.

It is believed that the present embodiment's design also conforms to Federal Regulations, Title 16, Volume 2 Part 1509 having side boarders, 2 inches thick and 6½ inches above the mattress and no spaces larger than 2⅜ inches between slats. The mattress does not leave a gap more than ½ inch at any point between the perimeter of the mattress and the perimeter of the crib and is within specified thickness. The entire unit meets the mechanical hazards requirements of 16 CFR 1500, "Federal Hazardous Substances Act Regulations".

Figure 2:
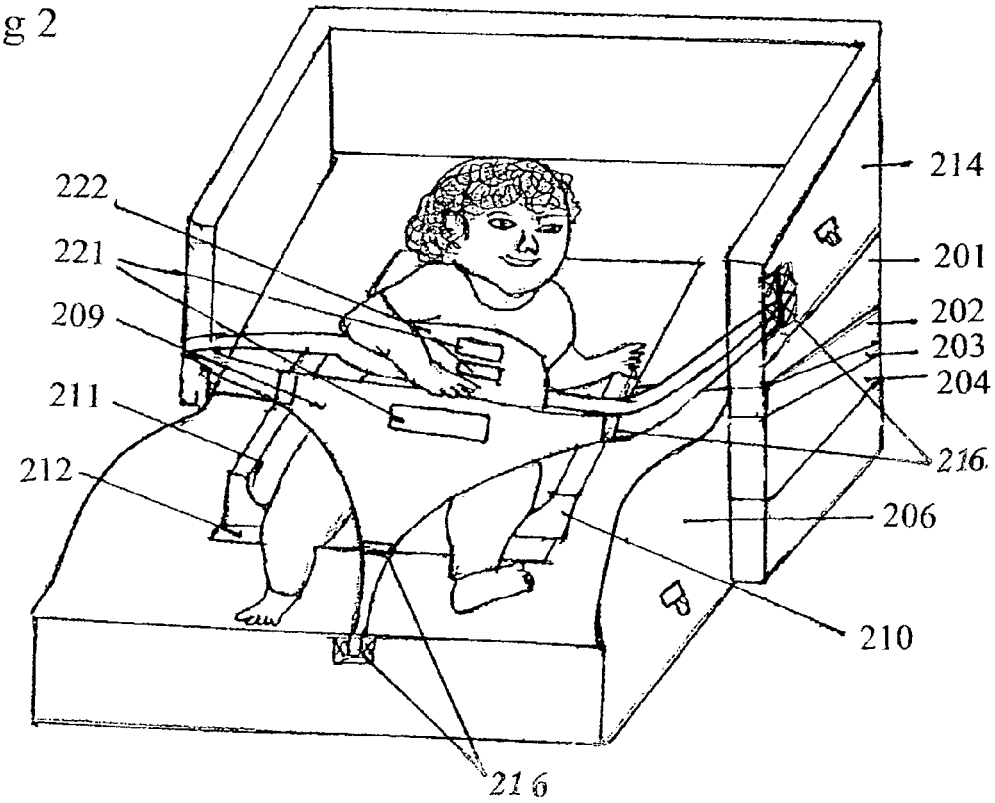
FIG. 2 shows a frontal and partial side view of an exemplary adjustable reclining bed, minus the foot base side boarders, demonstrating the lower body support and upper body elevation mechanisms, in accordance with an embodiment of the present invention.

FIG. 2 shows a frontal and partial side view of an exemplary adjustable reclining bed, without the foot base side boarders, demonstrating the lower body support and upper body elevator mechanisms, in accordance with an embodiment of the present invention. The upper body of the infant is elevated by adjusting the height of a head base 201. Head base 201 is raised or lowered by utilizing the removable foam elevating wedges 202, 203 and 204. The lower body of the infant is comfortably supported by the modified S curve design of a foot base 206, and the infant is positioned with positioning wedges 210 and 211. A triangular shaped harness 209 attached to a waterproof vinyl mattress pad 212 with hook and loop fasteners 216, helps hold the infant stable on the bed and assists with positioning by providing some support to the lower body when in elevated positions. Harness 209 is also attached with hook and loop fasteners 216 to head base side boarders 214 and foot base 206 and has a hook and loop strip 221 for further securing of medical equipment. A soft cloth 222, wide hand type belt that can be secured around the chest or to the head side boarders with hook and loop fasteners, gives further support and/or provides for securing and positioning of a pacifier or medical cords or tubes with hook and loop fastener strip 221 and will be available separately as well as being included in present embodiment. The use of hook and loop fasteners allows for any type of harness to be substituted as the required hook fastener can be glued or sewn on to existing harness strap or belts. An actual restraining harness vest could be employed for more active infants or a larger rectangular soft cloth harness that covers both the chest and lower body with straps at the shoulders and waist of the infant may be substituted, for positioning of the compromised infant. The larger rectangular harness or vest type harness incorporates hook and loop fasteners on it's surface for securing of medical equipment. The vest type harness with hook and loop strip fasteners for medical equipment will be available separately for older children. The traditional safety belt, being secured to the head and foot bases and connecting at infants waist, employed in common infant seats may also be used but would not provide the support of the lower body as well as the triangular shaped harness, and may be more restricting to the baby and less comfortable around the waist.

Figure 3:
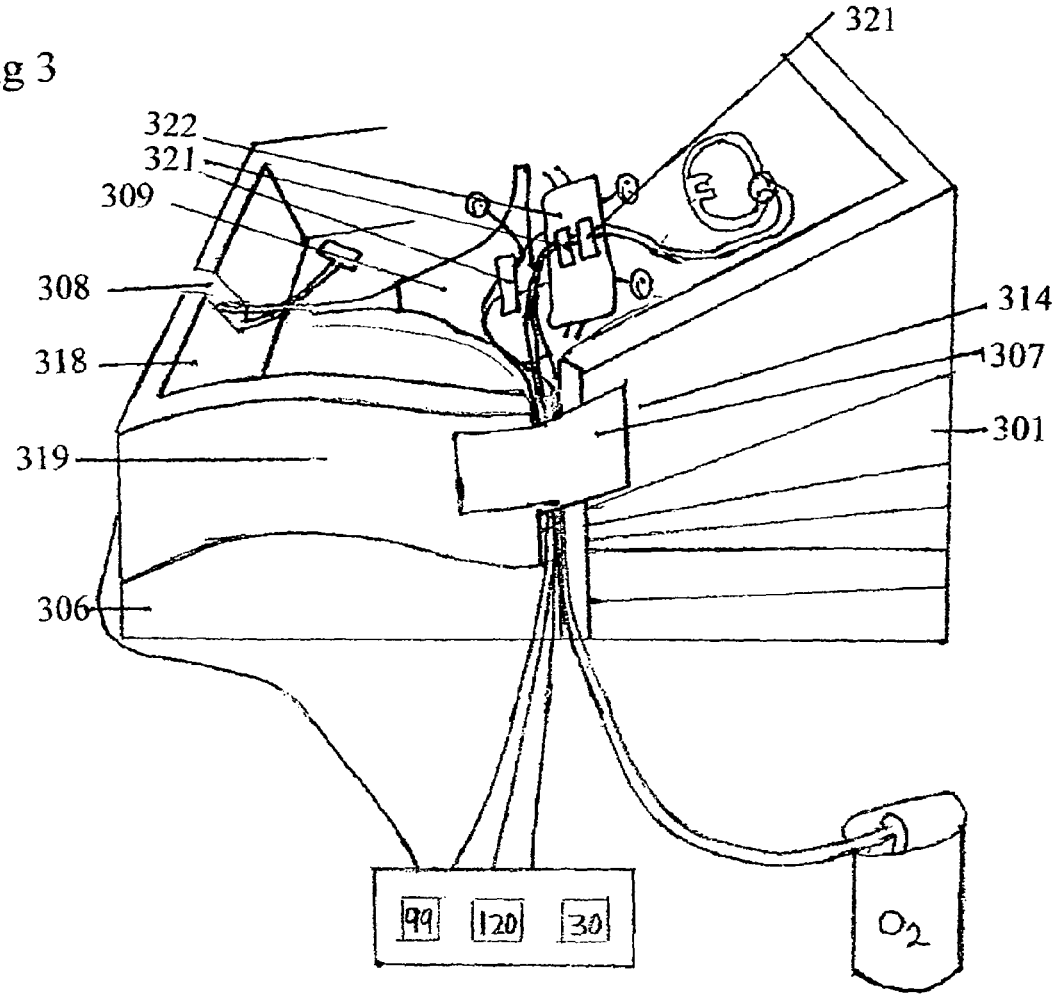
FIG. 3 is a partial side view of an exemplary adjustable reclining bed showing the connection point of a head base 301 and a foot base 306, with harnesses 309 and 322 in use for securing medical equipment, in accordance with an embodiment of the present invention.

FIG. 3 is a partial side view of an exemplary adjustable reclining bed showing the connection point of a head base 301 and a foot base 306, in accordance with an embodiment of the present invention. In the present embodiment, 8-inch high, 2-inch thick overlapping side boarders of head base 314 and foot base 319 are connected with 11 inch long 2 inch high vinyl connector flaps 307 and hook and loop fasteners. The space between overlapping side boarders 314 and 319 allows for monitor cables or medical tubing to reach the infant. A 5½ inch long and ½ inch wide slit 308 in the bottom side border of foot base 318 can also be used to secure monitor cables and oxygen tubing, helping to prevent entanglement of the cables or possible constriction of the limbs or neck of the infant. Further prevention of entanglement of cables may be achieved with use of harnesses 309 and 322, having hook and loop fasteners 321 for securing of medical equipment. In an alternate embodiment of the present invention, a vibrator wand may be placed under the mattress providing a comforting mechanism for the infant (not shown). An alternate mattress embodiment further includes a heating and massage/vibrating device incorporated in its structure with a pulsing rhythm and possible the sound of heartbeats to soothe the infant. Yet another embodiment of the mattress includes an air mattress with different sections that has an air pump to adjust inflation levels, assisting with positioning of the infant and/or possibly providing rhythmic motion and swishing sound of heart beat as well as warming or cooling air. The mattress of the present embodiment has a small built in pad of memory foam in the area of the buttocks, for comfort and prevention of pressure sores that is effectively covered with the vinyl mattress pad, thereby preventing suffocation risk.

Figure 4:
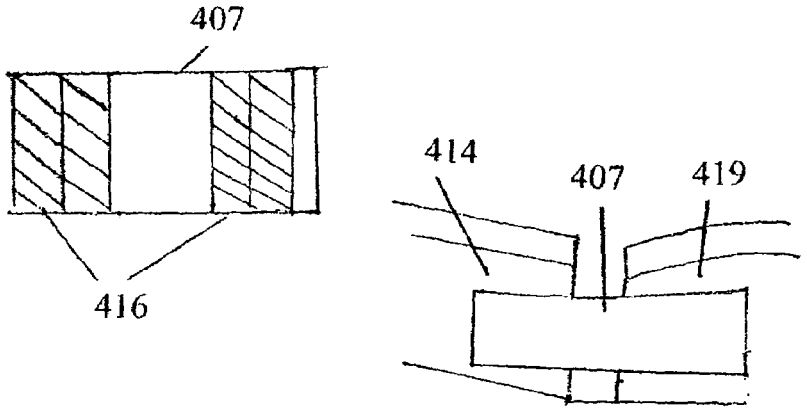
FIG. 4 is a detailed view of exemplary side connector flaps 407 that hold together the head and foot bases of the bed, in accordance with an embodiment of the present invention

FIG. 4 is a detailed view of exemplary side connector flaps 407 that hold together for side boarders of the head and foot bases of the bed, in accordance with an embodiment of the present invention. Vinyl side connector flaps 407 are attached with hook 416 and loop fasteners on the outside of side borders 414 of the head base and the outside of the side borders 419 of the foot base. This provides continuity of closure of the side boarders in the more reclining positions, connecting the head and foot side boarders and thereby reinforcing strength of the anion of the head and foot boarders at the conjunction sites, as well as leaving space for ports for the cables, medical tubing, etc mentioned in the description of FIG. 3.

Figure 5:
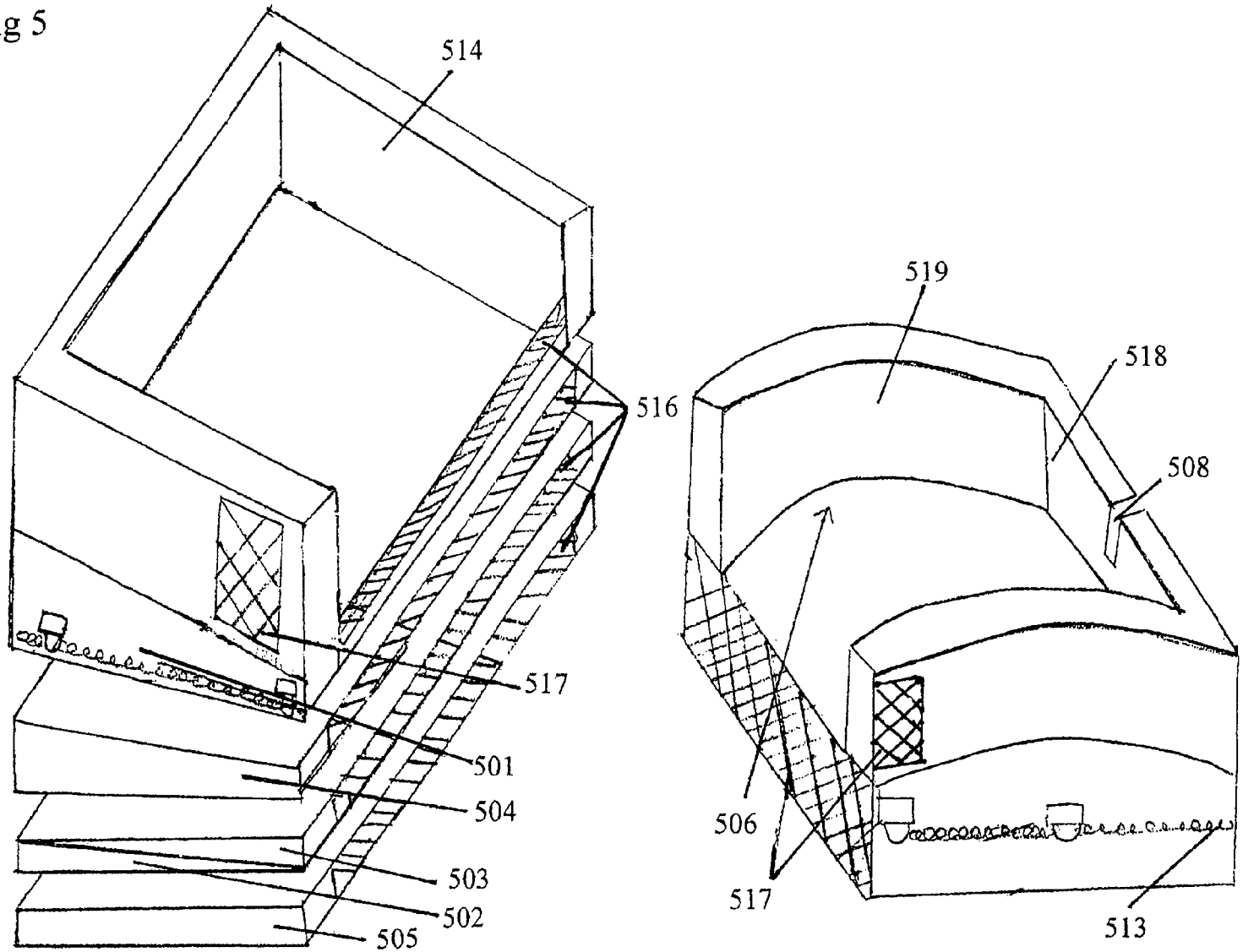
FIG. 5 illustrates an exploded view of the components of the bases and elevating wedges of an exemplary adjustable reclining bed, in accordance with an embodiment of the present invention.

FIG. 5 illustrates an exploded view of the components of the bases and elevating wedges of an exemplary adjustable reclining bed, in accordance with an embodiment of the present invention. A head base 501 and a foot base 506 are connected at the center of the bed with hook fasteners 516 and loop fastener 517. Foot base 506 has a modified S curve design that comfortably supports the lower body of the infant without restricting blood circulation, and helps to prevent the infant from sliding down and possibly occluding the airway or contributing to poor air exchange to the lungs. In the present embodiment, head base 501 is 4 inches wider than foot base 506 providing better stability and a larger surface area for head base 501, and allowing for increased airflow to the infant. Side boarders 514 of head base 501 overlap side boarders 519 of foot base 506 and are connected by a vinyl flap, not pictured, with hook fasteners 516 and loop fasteners 517. The bottom foot side boarder 518 has a slit 508 for securing of harness and medical equipment. Placement of loop fasteners 517 on the outside of side boarder 514 of head base 501 and outside side boarder 519 of foot base 506 as well as hook fasteners 516 on the elevating wedges 502, 503 and 504, elevating base 505, and loop fastener 517 on foot base 506 allow for the easy assembly, reconfiguration and disassembly of the bed. The bed can be easily dismounted for cleaning, disinfecting, portability or storage. The present embodiment is comprised of a head 501 and foot base 506, two 2 inch angled foam wedges 502 and 503, a 4 inch angled wedge 504, and a 1½ flat base wedge 505. Also pictured is an anchoring cord 513 attached to head base 501 and foot base 506 to anchor the bed to a crib and help prevent tipping by the more vigorous infant. In alternate embodiments of the present invention, the head base could have a metal, molded plastic, or aluminum frame that could be elevated manually with a mechanism like that typically employed in lawn chairs, or it could be electrically powered and on a remote control like a hospital bed. Measures would preferably be taken to prevent pinching hazards for hands and feet by the elevating mechanisms. The top, side boarder of the head base could have slits for securing of medical equipment or it could be removable being secured to the side, side boarders with hook and loop fasteners.

Figure 6:
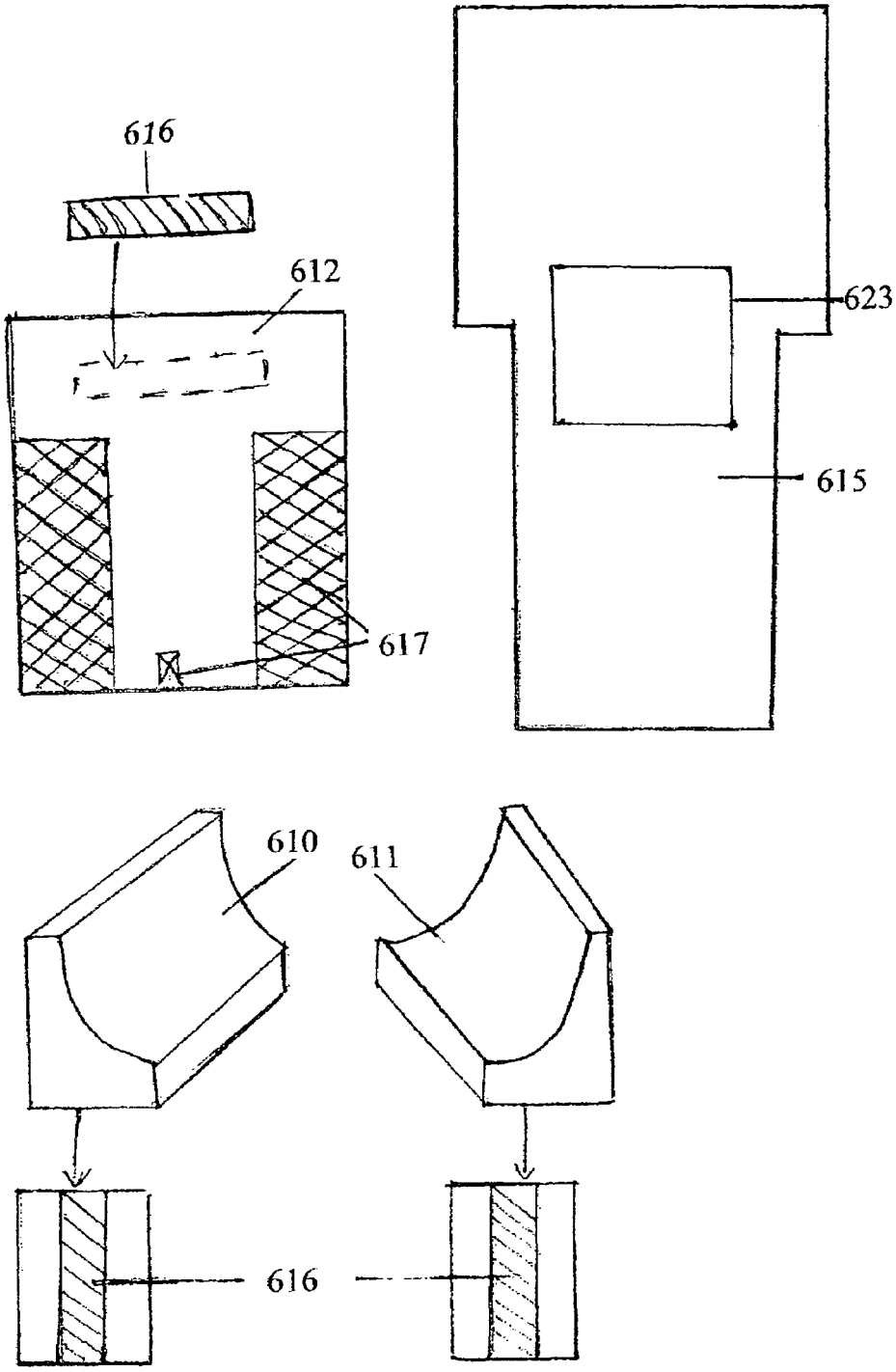
FIG. 6 shows two exemplary positioning wedges 610 and 611, the mattress pad they attach to 612 and a separate mattress 615, for an adjustable reclining bed, in accordance with an embodiment of the present invention.

FIG. 6 shows two exemplary positioning wedges 610 and 611 for an adjustable reclining bed, in accordance with an embodiment of the present invention. In the present embodiment, positioning wedges 610 and 611 have hook fasteners 616 on their bottom surfaces that attach to a separate vinyl mattress pad 612 with loop fasteners 617 for further securing of infant to achieve effective positioning of the infant in the bed. The mattress pad has a strip of hook fastener 616 at top backside, which attached to a loop strip sewn on the sheet covering the mattress. In the present embodiment, positioning wedges 610 and 611 are preferably constructed of fire retardant foam, covered with fir retardant material, an Alessandra FR Jersey Knit Sleeve, and an outer covering of nonporous, waterproof, mildew resistant 2 mil PUL, with fire retardant hook fasteners or covered with non-flammable, waterproof material, including, not limited to paint, with fire retardant hook fasteners 616. Positioning wedges 610 and 611 can be easily wiped down and disinfected. The mattress pad 612 is preferably made of flame retardant, nonporous vinyl or rubber with fire retardant loop fasteners 617. In the present embodiment, a cut to form mattress 615 is 1½ inches thick, 32 inches long, 19¼ inches wide at head and 15 inches wide at foot, and of the same foam construction and covering used on the other foam components described. Mattress 615 provides the firm flat sleeping and positioning surface recommended by the American Academy of Pediatrics for the prevention of SIDS. In addition, depicted is a square of memory foam 623 inserted in the mattress at the buttocks area for further comfort and prevention of pressure sores.

Figure 7:
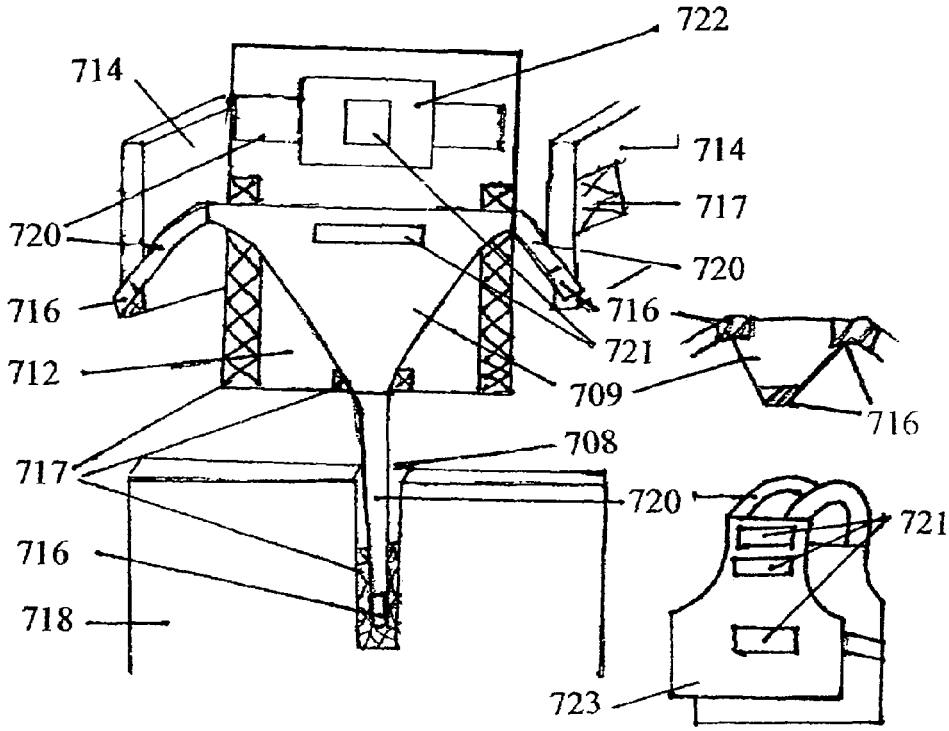
FIG. 7 illustrates an exemplary safety harness 709 intended to stabilize an infant in an adjustable reclining bed, in accordance with an embodiment of the present invention; and a soft cloth type wide band belt 722 with hook and loop fasteners 721 for securing medical equipment and/or assisting with positioning and support of chest, that can be secured around the infants chest and back or in the head base with hook and loop fasteners and an alternative vest type harness 723 with hook and loop fasteners 721 for securing medical equipment that would also be suitable for toddlers and older children.

FIG. 7 illustrates an exemplary safety harness 709 intended to stabilize an infant in an adjustable reclining bed, in accordance with an embodiment of the present invention. In the present embodiment harness 709 is triangular in shape, and preferably constructed of fire retardant waterproof material with a latex free elastic 720 and hook fastener 716. There is also a hook and loop fastener on the harness 721 for securing and positioning medical cables and tubes, or rattles. Its triangular design, in conjunction with the positioning wedges discussed in FIG. 6, provides safety, preventing the infant from falling out of the bed, and added support to lower body for positioning. In the present embodiment, there is an additional soft cloth, wide band type belt 722 with hook and loop fastener 721 for securing and positioning medical equipment, pacifiers, or rattles that can be secured across the infants chest and fastened at the back or can give additional support by being fastened to the head base in same manner as triangular harness. Also depicted is an alternative vest type harness 723 for securing of medical equipment for toddlers or older children. Harness 709 is attached to a vinyl mattress pad 712, head side borders 714, and foot bottom sides boarder 718, with hook 716 and loop 717 fasteners through ports afforded by overlapping head side borders 714 and foot side borders (not pictured) where the bases are conjoined. In the present embodiment, there is a ½ inch wide 5½ inch long slit 708 in bottom foot side border 718 that allows for attachment of the harness 709 hook fastener 716 to the loop fastener 717 on the foot base bottom side boarder 718.

Figure 8:
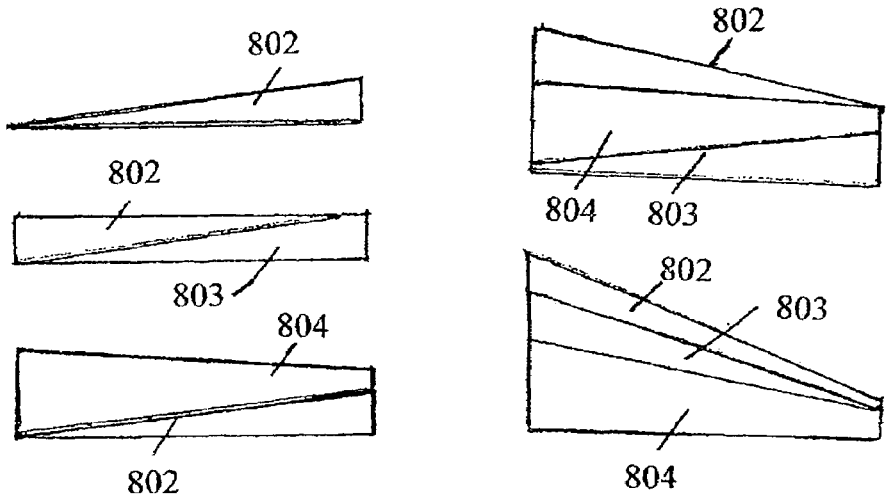
FIG. 8 illustrates five exemplary positions possible with three removable elevating wedges, in accordance with an embodiment of the present invention.

FIG. 8 illustrates five exemplary positions possible with three removable elevating wedges, in accordance with an embodiment of the present invention. The present embodiment is comprised of two 2-inch high angled wedges 802 and 803, and a 4-inch high angled wedge 804. These three wedges can be configured to provide 5 different degrees of elevation from approximately 20 to 50 degrees. The wedges attach to center side of foot base with hook, and loop fasteners so they can be easily assembled, reconfigured and disassembled.

In an alternative embodiment of the present invention, the S curve base and wedges for elevation are implemented without the side boarders or mattress. This embodiment would be as wide as the crib mattress so that the enclosure of the crib would prevent infant from rolling off. However, this embodiment may be less versatile and more limiting for infant use than the embodiment with side borders and may be more difficult physically adjusting the height to utilize in the crib, being the same width as the mattress. Also, the harness would be less effective for positioning of the infant, as it would have to cover a greater width, not being as snug fitting and the straps may have to be long enough to pose a strangulation hazard. In alternate embodiments of the present invention, provisions are made to secure the harness with hook and loop fasteners to the surface of and more towards the center of the foam base, closer to the infants body to provide a more secure fit or a separate mattress of same width as base, with slits on both sides of mattress for placement of a security belt or harness inserted through the slits and under the mattress and connecting at child's waist, like conventional safety belts on infant seats, could be employed. Both of these embodiments would typically require slits in the covering sheet allowing access to the base or mattress. A vest type restraint could also be employed. This embodiment would be more suitable for a toddler on up to adulthood.

In an alternate embodiment of the present invention, the base may be all one piece with only the elevating wedges being separate. However, this embodiment would be more difficult to reconfigure and may tear after repeated uses. This embodiment would be more appropriate for use in smaller scale as a toy doll bed.

In other alternative embodiments of the present invention, the non-rigid frame and wedges are replaced with a rigid support structure such as molded plastic, or wood with hinges or metal such as, but not limited to aluminum. The adjustable bed could have a mechanism for elevating the head and feet similar to that of a lawn chair. An alternate embodiment could employ a mechanical device to change degree of elevation, similar to a miniature hospital bed with an electrical vibration unit that could run on batteries or require an electrical plug. A metal embodiment would preferably have a plastic or metal frame with upholstery for the side borders. Another embodiment is a combination metal and foam frame that could be elevated like a lawn chain or with a mechanical device. However, these embodiments could pose a pinching hazard for hands and feet around the elevating mechanism and a lighter aluminum frame may not be as stable as the original embodiment of foam. However, a heavy metal or wooden frame may be heavier and more difficult to transport and store. These embodiments may also require an electrical outlet for the elevating mechanism. Automated mechanical means of elevation will also add to the cost, as would the addition of a metal framework in the foam structure.

The foregoing embodiments of the present invention comprise a multiplicity of aspects, which, for the sake of clarity, are next highlighted separately by way of example and not limitation. For example, one aspect of the preferred embodiment of the present invention is to provide adjustable elevation of an infant's head with the use of multiple removable foam wedges that provide multiple possible degrees of elevation (approximately 20 to 50 degree range) and allow for comfortable, effective, versatile positioning of the head and chest of the compromised infant without mechanical hinges or devices to elevate the head that pose a pinching risk for hands and feet. Also, the foam mattress included provides a firm flat sleeping and positioning surface, which is recommended by the American Academy of Pediatrics for the prevention of SIDS.

Another aspect of the preferred embodiment, provides for a modified S curve of the foot base, comfortably supports the buttocks and legs, without restricting blood circulation to the lower body and helps to prevent the infant from slipping down and possibly slumping the head and neck and occluding the airway or causing poor air exchange to the lungs. The design of the preferred embodiment allows for the recommended supine, as well as prone and side lying positioning of the infant.

Yet another aspect of the preferred embodiment of the present invention is that the head base is wider than the foot base, providing, a larger surface area for the head and increased airflow to the baby, and also provides stability to the bed and forms ports for cables, tubes and a vibrator wand where side boarders of head and foot connect and overlap. Another aspect is a slit in the bottom side boarder of the foot base that may be used to secure monitor cables and or intravenous and oxygen tubing frequently employed in the care of the compromised infant. It is contemplated that the entire unit of the present embodiment being constructed of foam, can be altered by the consumer to fit their specific needs, however cutting through the fire retardant material will change the flammability status. Hook and loop fasteners may be glued to the foam structure where desired to secure medical equipment or frequently used items. There could be slits cut or already incorporated into the top or sides of the head side boarders providing additional ports for securing medical equipment, and the head side boarder may be removable being attached to the side, side boarders with hook and loop fasteners. The bottom side boarder could be detachable in the same manner. The side boarders of the head and foot base could be made of a transparent, non-flammable, inflatable plastic that would allow vision of the infant through the side boarders in addition to previously mentioned features. Some kind of fan mechanism or air pump could circulate different shaped and colored objects through the transparent plastic side boarders to entertain the infant or make rhythmic heart beat sounds to soothe the infant.

Another aspect of the preferred embodiment of the present invention is a triangular harness with accompanying soft cloth wide band type belt for chest, both with hook and loop fasteners for securing medical equipment, etc, attached to the bed and/or mattress pad for safety and effective positioning of the infant, and a safety cord around the base for anchoring bed to crib preventing toppling by more vigorous infants.

Another aspect of the preferred embodiment of the present invention is that it can be easily cleaned and disinfected, and it meets most, if not all, sanitation needs in the hospital setting, allowing for repeated use. Another aspect of the preferred embodiment of the present invention is that is constructed of fire retardant foam and non-flammable or fire retardant and waterproof materials.

Embodiments of the present invention may be used in the hospital or home care setting for use by the compromised or healthy premature or newborn infant.

Alternative embodiments may address cost reduction or regulatory issues for certain applications. For example, the cost of the covering may be reduced by covering with some other fire retardant material and an outer waterproof covering instead of covering foam with the Alessandra FR Jersey Knit Sleeve and 2 mil Pul for the layers that need to pass the CA TB 603 regulator requirement of the testing will have to be Having fully described at least one embodiment of the present invention, other equivalent or alternative methods of implementing an adjustable reclining infant bed according to the present invention will be apparent to those skilled in the art. The invention has been described above by way of example, and the specific embodiments disclosed are not intended to limit the invention to the particular forms disclosed. This invention is thus to cover all modifications, equivalents, and alternatives falling within the spirit and scope of the following claims.

What is claimed is:

1. An adjustable reclining infant bed apparatus comprising:

bed means for supporting an infant with a modified S curve shape and enclosing the infant on four sides with at least two solid borders where gaps between said solid borders enable access to an interior of said bed means from exterior sides of said solid borders;

means for substantially covering a supporting portion of said bed means;

means for covering a portion of said means for substantially covering a supporting portion; and elevating means for adjusting an inclination of a portion of said bed means.

2. The apparatus as recited in claim 1, further comprising: torso support means for supporting a torso of the infant.

3. The apparatus as recited in claim 2, further comprising: positioning means for facilitating proper body alignment of the infant in said bed means.

4. The apparatus as recited in claim 2, further comprising: securing means for securing cables and tubes passed into said bed means.

5. The apparatus as recited in claim 2, further comprising: means for providing chest support for the infant.

6. The apparatus as recited in claim 2, further comprising: means for securing said bed means to a crib.

7. An adjustable reclining infant bed apparatus comprising:

a head base having a generally rectangular shape, said head base comprising a generally flat upper body support surface for an infant, and a head base border extending above said upper body support surface on three sides of a periphery of said upper body support surface leaving a fourth side of said periphery open;

a foot base having a generally rectangular shape and a width smaller than said head base, said foot base comprising a lower body support surface having a modified S curve shape and a foot base border extending above said lower body support surface on three sides of a periphery of said lower body support surface leaving a fourth side of said periphery open, said foot base joinable to said head base where said fourth side of said periphery of said upper body support surface and said fourth side of said periphery of said lower body support surface are adjacent to form a generally rectangular enclosure within said head base border and said foot base border about said upper body support surface and said lower body support surface, where a difference in width of said head base and said foot base forms gaps between said head base border and said foot base border to enable access to an interior of said enclosure from exterior sides of said foot base border;

at least one elevating wedge joinable to said foot base, said elevating wedge positioned beneath said head base and operable to elevate said head base at an angle;

at least two connecting flaps each joinable to said head base border and said foot base border and passing over said gaps, said at least two connecting flaps operable to reinforce the joining of said head base to said foot base, said at least two connecting flaps having a width smaller than a height of said head border and a height of said foot base border where said at least two connecting flaps form ports in said gaps;

a generally flat mattress dimensioned to fit in said enclosure and substantially cover said upper body support surface and said lower body support surface;

a generally flat mattress pad dimensioned to cover a portion of said flat mattress; and a triangular harness comprising one attachable point for joining to said foot base and two attachable points for joining to said head base, said triangular harness joinable to said mattress pad and configured to support a torso of the infant.

8. The apparatus as recited in claim 7, further comprising additional elevating wedges joinable to said foot base for further elevating said head base.

9. The apparatus as recited in claim 7, further comprising a plurality of positioning wedges configured to support sides of the infant.

10. The apparatus as recited in claim 9, in which said positioning wedges are joinable to said mattress pad.

11. The apparatus as recited in claim 7, further including a wide band belt configured to provide chest support for the infant, said wide band belt being attachable to said head base.

12. The apparatus as recited in claim 11, in which said wide band belt comprises attachable strips configured for securing cables and tubes.

13. The apparatus as recited in claim 7, in which said ports have a configuration for securing cables and tubes passing into the apparatus.

14. The apparatus as recited in claim 7, in which said triangular harness comprises attachable strips configured for securing cables and tubes.

15. The apparatus as recited in claim 7, further including a vest harness configured to provide medical equipment support for the infant.

16. The apparatus as recited in claim 15, in which said vest harness comprises attachable strips configured for securing cables and tubes.

17. The apparatus as recited in claim 7, in which a bottom end side of said foot base border comprises a slot configured for passing cables and tubes into said apparatus.

18. The apparatus as recited in claim 17, in which said one attachable point of said triangular harness passes through said slot to join to said foot base.

19. The apparatus as recited in claim 7, in which said head base and said foot base are constructed from a foam type material.

20. The apparatus as recited in claim 7, in which said mattress comprises an insert of memory type foam in a buttocks support area for comfort and prevention of pressure sores.

21. The apparatus as recited in claim 7, further comprising a safety cord-joinable to a side of said foot base and an adjoining side of said head base border, said safety cord operable for securing the apparatus to a crib.

* * * * *